US005847722A

United States Patent [19]

Hackleman

[11] Patent Number: 5,847,722

[45] Date of Patent: Dec. 8, 1998

[54] INKJET PRINTHEAD ALIGNMENT VIA MEASUREMENT AND ENTRY

[75] Inventor: David E. Hackleman, Monmouth, Oreg.

[73] Assignee: Hewlett-Packard Company, Palo Alto, Calif.

[21] Appl. No.: 562,237

[22] Filed: Nov. 21, 1995

[51] Int. Cl.[6] ..... B41J 29/393

[52] U.S. Cl. ..... 347/19

[58] Field of Search ..... 347/19, 14, 37

[56] References Cited

U.S. PATENT DOCUMENTS

| | | | |
|---|---|---|---|
| 4,570,167 | 2/1986 | Sugitani et al. . | |
| 4,570,168 | 2/1986 | Sjordal et al. . | |
| 4,626,867 | 12/1986 | Furukawa et al. . | |
| 4,709,245 | 11/1987 | Piatt . | |
| 5,109,239 | 4/1992 | Cobbs et al. . | |
| 5,250,956 | 10/1993 | Haselby et al. . | |
| 5,276,467 | 1/1994 | Meyer et al. . | |
| 5,289,208 | 2/1994 | Haselby . | |
| 5,297,017 | 3/1994 | Haselby et al. . | |
| 5,408,746 | 4/1995 | Thoman et al. . | |
| 5,442,383 | 8/1995 | Fuse | 347/19 |
| 5,448,269 | 9/1995 | Beauchamp et al. | 347/19 |
| 5,504,507 | 4/1996 | Watrobski et al. | 347/19 |

FOREIGN PATENT DOCUMENTS

| | | |
|---|---|---|
| 0313205 | 4/1989 | European Pat. Off. . |
| 421806A2 | 4/1991 | European Pat. Off. . |
| 539157A2 | 4/1993 | European Pat. Off. . |
| 540245A2 | 5/1993 | European Pat. Off. . |
| 622236A2 | 11/1994 | European Pat. Off. . |
| 626266A2 | 11/1994 | European Pat. Off. . |

*Primary Examiner*—Shawn Riley

[57] ABSTRACT

Optical measurement is made for each nozzle position of a printhead relative to each printhead of an inkjet printing device. Alternatively, the measurement is made for each nozzle relative to a reference point. The reference point, for example, is a datum projection or indentation (i) on the printhead, (ii) integral to the pen body, or (iii) on the pen carriage. The measurement data subsequently is stored for later access. Alternative storage schemes include local storage in electronic memory associated with the pen and physical storage via bar code, magnetic stripes or physical markings. The stored alignment data thereafter is retrieved and input to printhead nozzle management software to adjust the timing for firing respective nozzles. The timing is adjusted to compensate for misalignment and achieve accurate dot placement on a media sheet.

24 Claims, 3 Drawing Sheets

INKJET PRINTHEAD ALIGNMENT VIA MEASUREMENT AND ENTRY

BACKGROUND OF THE INVENTION

This invention relates generally to inkjet printer construction, and more particularly to alignment of inkjet printhead(s) and timing for firing inkjet nozzles.

Inkjet printheads operate by ejecting a droplet of ink through a nozzle onto a media sheet. When a number of nozzles are arranged in a pattern, such as into one or more linear arrays, a properly sequenced ejection of ink from each nozzle causes characters or other images to be printed onto the media sheet. For a scanning-type printer, the printhead is scanned across the media sheet, while the media sheet is registered to move along a media path. A timing sequence for firing the nozzles determines the markings and quality of markings applied to the media sheet.

Color inkjet printers typically include a plurality of printheads, for example four, mounted in a print carriage to produce different colors. Each printhead corresponds to ink of a different color, with black, cyan magenta and yellow being the common colors. These base colors are produced by ejecting a drop of desired color onto an appropriate dot location. Secondary or shaded colors are formed by depositing multiple colors onto the same dot location. Print quality is especially important for color printing where the colors must overlay precisely to create the desired shading or secondary color. One source of degradation is improper placement of the ink drop.

Inkjet printing resolutions of 300 dots per inch and 600 dots per inch ("dpi") are common. To achieve accurate placement of the ink drop on the media sheet, alignment of the nozzle and media sheet is required. One approach for alignment is to position the printheads and media sheet at absolute known locations. This approach is referred to as absolute positioning. The inkjet carriage assembly is positioned at a known position within the printer. The carriage is positioned at a known position on the carriage assembly. The inkjet pens are positioned at known positions on the carriage. Each printhead is positioned at a known position on its pen and each nozzles is positioned at known positions on the printhead. Force loading is one known method for positioning a pen at a desired location. Precise alignment between two or more inkjet printheads affixed to print cartridges installed in a single carriage is achieved by machining datum projections on each print cartridge after its printhead has been permanently installed. Absolute positioning also is performed for the media sheet and media handling subsystem. The absolute positioning approach requires precise manufacturing and assembly of components. At the desired accuracies, absolute positioning is expensive and difficult to achieve.

An alternative approach is to achieve careful relative positioning. Relative positioning involves modifying the timing when firing nozzles to compensate for variations in absolute alignment. According to one known method, test line segments printed by a printhead are optically detected to determine variations in alignment. The printhead firing sequence is calibrated to reduce or eliminate the variations in absolute alignment. According to another known method, drops are fired through an aperture plate. A pattern of detects and no detects of ink at the aperture plate identifies variations in absolute alignment and allows for compensation. Other approaches include optically detecting passage of a printhead past a known position along its scanning path.

SUMMARY OF THE INVENTION

According to the invention, rather than manufacture a printhead to be absolutely aligned relative to its support assembly, looser tolerances are allowed during manufacture. Once the printhead is permanently secured relative to its support assembly and the pen is installed in its shuttle carriage, the printhead nozzle positions are measured optically. The position measurements are stored, then used later for calibrating the nozzle timing. Because it is easier to measure to finer precision than to manufacture to fine precision, a more efficient (i.e., less costly) and highly effective method is achieved for printing accurately.

According to one aspect of the invention, an optical measurement is made for each nozzle position relative to each printhead of the printer. Alternatively, the measurement is made for each nozzle relative to a reference point. The reference point, for example, is a datum projection or indentation (i) on the printhead, (ii) integral to the pen body, or (iii) on the pen carriage. This optical measurement data is indicative of printhead alignment or misalignment.

According to another aspect of the invention, the measurement data is stored for later access. Alternative storage schemes include local storage in electronic memory associated with the pen and physical storage via a bar code or similar pattern. Because the nozzles may exhibit a pattern of non-alignment (e.g., same offset for every nozzle or a rotation progressive among nozzles), another method for storing the measurement data is to apply markings to the pen which exaggerate the lack of alignment. For example, if adjacent nozzles are offset by 0.02 inches in one dimension (e.g., x-axis) and by 0.04 inches in another dimension (e.g., y-axis) and the nozzle array is rotated by 0.1 degrees, a set of two markings (e.g., crosses) is applied to the pen at 0.2 inch and 0.4 inch offsets and rotated by 100 degrees. For such example, the offsets are exaggerated by a known factor of 10 and the rotation is exaggerated by a known factor of 1000. In a preferred embodiment mechanical crosses are used. One cross is fixed, while the other is movable and rotatable to set the cross at an x, y and rotational offset.

According to another aspect of the invention, the stored alignment data is retrieved and input to printhead nozzle management software to adjust the timing for firing respective nozzles. The timing is adjusted to compensate for misalignment and achieve accurate dot placement on a media sheet. According to alternative methods, the alignment data is automatically read or manually fed into the nozzle management software. For example, data stored in local memory is accessed electronically and input to the management software. Alternatively an optical device scans the bar code and feeds the data to the management software. Alternatively a user types in the data to a computer coupled to the printer, (e.g., using a utility program environment). The data then is fed to the printer's nozzle management software.

One advantage of the invention is the manufacturing tolerances for printer carriage and pen components can be slightly relaxed where burdensome. Such relaxed tolerances are accounted for by the optical measurement and storage of alignment data. Thus, one or more printheads are able to print to desired accuracies. These and other aspects and advantages of the invention will be better understood by reference to the following detailed description taken in conjunction with the accompanying drawings.

DESCRIPTION OF SPECIFIC EMBODIMENTS

Inkjet Printing Device and Printhead Misalignment

Figure 1:
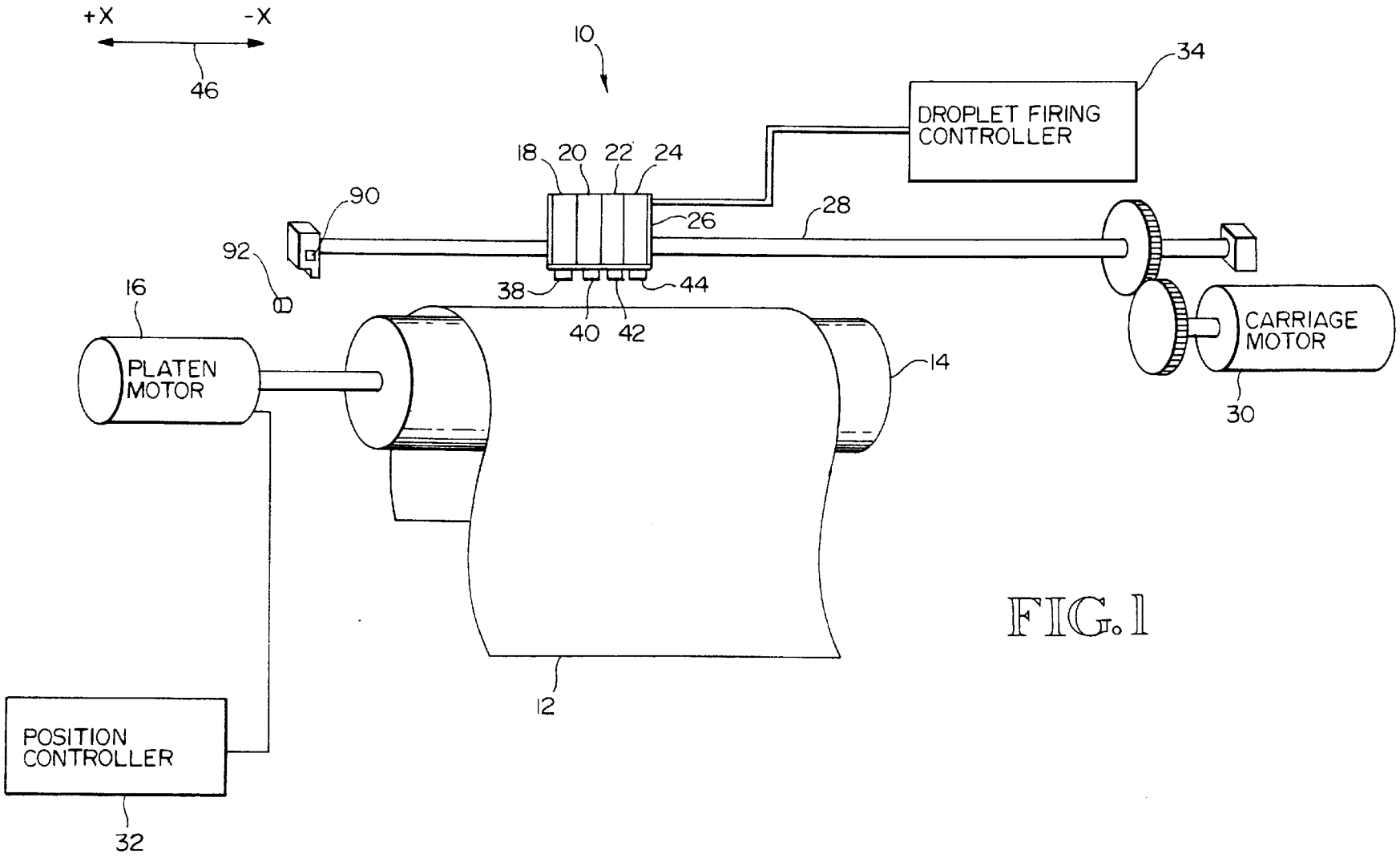
FIG. 1 is a block diagram of an inkjet printing device.

The present invention encompasses a method and apparatus for compensating for misalignment of inkjet printheads and printhead nozzles. Misalignment is measured optically with measurements stored for later access. The measurements are subsequently used to adjust the timing for firing inkjet printhead nozzles. FIG. 1 shows a simplified block diagram of an inkjet printing apparatus 10. A media sheet 12 is driven along a media path via a drive roller 14 and platen motor 16 in a direction arbitrarily designated as the "y" direction. The media sheet 12 is moved adjacent to inkjet pens 18, 20, 22,24. The pens 18–24 are mounted in a carriage 26 and scanned in an "x" direction along a rod 28 by a carriage motor 30. A position controller 32, as further described in U.S. Pat. No. 5,070,410, controls the platen motor 16 and carriage motor 30.

During operation, the media sheet 12 is positioned adjacent to the inkjet pens 18–24. The pens eject ink droplets onto the media sheet in desired patterns to form characters, symbols, graphics or other markings. A droplet firing controller 34 defines the timing for firing respective nozzles on the respective printheads 38, 40, 42, 44 of the pens 18, 20, 22, 24. Typically, the media sheet 12 is advanced incrementally (e.g., registered) or continuously, according to the specific embodiment. Also, droplets are ejected while scanning the sheet 12 in one direction along the x-axis 46, or in both directions along the x-axis 46.

Figure 2:
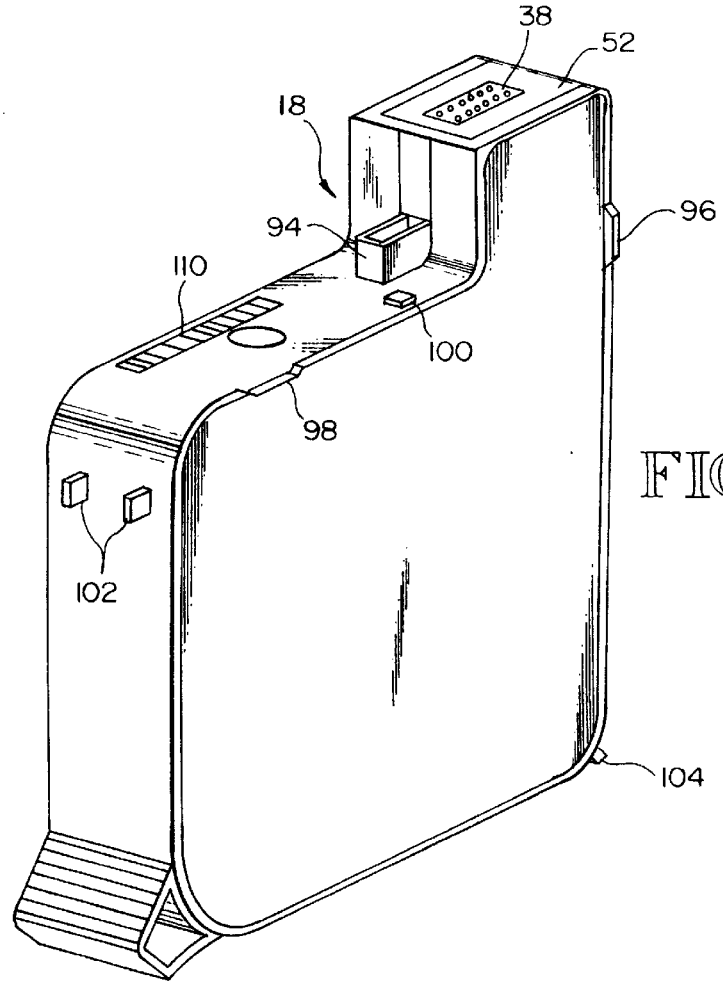
FIG. 2 is a perspective view of an inkjet pen cartridge.

FIG. 2 shows an inkjet pen 18 typical of all the pens 18–24. Typically, a portion of the pen volume is dedicated to the containment of ink. A printhead 38 is affixed at one end of the pen 18 and internally coupled to the supply of ink. Electrical connections are made to heated resistors within the printhead 38 by a flexible circuit 52. The flexible circuit 52 also couples to associated connectors at the carriage 26 (of FIG. 1). For multiple pen embodiments (e.g., colored printing devices), the pens are arranged side-by-side. Mating connectors (not shown) at the carriage 26 establish the electrical connections to the flexible circuit 52.

Figure 3:
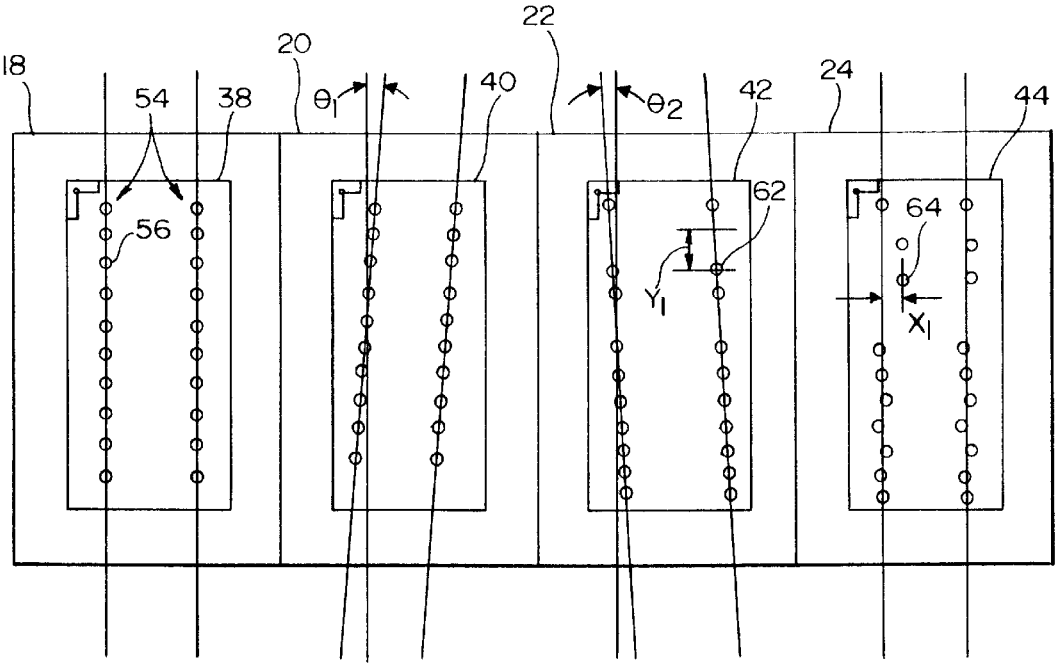
FIG. 3 is a partial planar view of side by side inkjet printheads.

FIG. 3 shows a portion of the pens 18–24, along with their associated printheads 38–44 arranged side-by-side. Each printhead includes one or more rows 54 of nozzles 56. The nozzles are aligned at a known orientation, typically parallel to the y direction. Often, however, the printhead or the nozzles are manufactured slightly out of alignment. For viewing and discussion purposes, the nozzles 56 in FIG. 3 are shown to be of an exaggerated size and spacing, and to be out of alignment by an exaggerated amount. For printhead 38 the nozzles are shown in two properly aligned rows at uniform spacing and orientation. For printhead 40 the nozzles are shown in two parallel rows at uniform spacing. The rows, however, are at a skewed rotation relative to the y direction. For printhead 42 the nozzles are shown in two parallel rows at a skewed direction different than for printhead 40. The printhead 42 nozzles also are shown to be of nonuniform spacing along the length of each row. For example, a nozzle 62 is offset by a distance y1 relative to a uniform spacing location along the row for such nozzle. For printhead 44 the rows and nozzles are out of alignment. The rows are skewed relative to the y direction. The nozzles are of non-uniform spacing along the length of each row. Several nozzles also are offset relative to the row orientation. For example nozzle 64 is offset in an x direction by a distance x1.

In other instances, a printhead or pen is offset or skewed relative to the other printheads or pens. Such misalignments typically occur during manufacture or assembly of the inkjet pen or inkjet printing device (e.g., printer, copier, fax). Prior solutions have addressed improvements in the manufacturing or assembly processes to achieve desired alignments. Alignments out of tolerance (i.e., misalignments) are treated as defects.

The following sections describe methods for measuring misalignment, storing such measurements, retrieving such measurement and compensating for misalignment.

Optical Measurement

Although, manufacturing and assembly to tight tolerances may be performed as in prior approaches, tolerances alternatively may be relaxed to accept greater misalignment during the manufacture and assembly steps. Preferably the pen is aligned to achieve a good interconnection between printhead and off-printhead electronic signal paths. In addition it also is preferred that the flexible circuit 52 be reliably sealed to the pen body so as not to bubble or otherwise exhibit significant offsets out of the plane of the printhead (i.e., in a z direction orthogonal to the x and y directions). Further, it is preferred that for any given nozzle the nozzle opening be aligned with its corresponding firing chamber to an accuracy necessary for a desired print quality. With such accuracy starting points remaining in the manufacturing process, misalignments in manufacturing and assembling the printheads with respect to its pen body are addressed.

Figure 4:
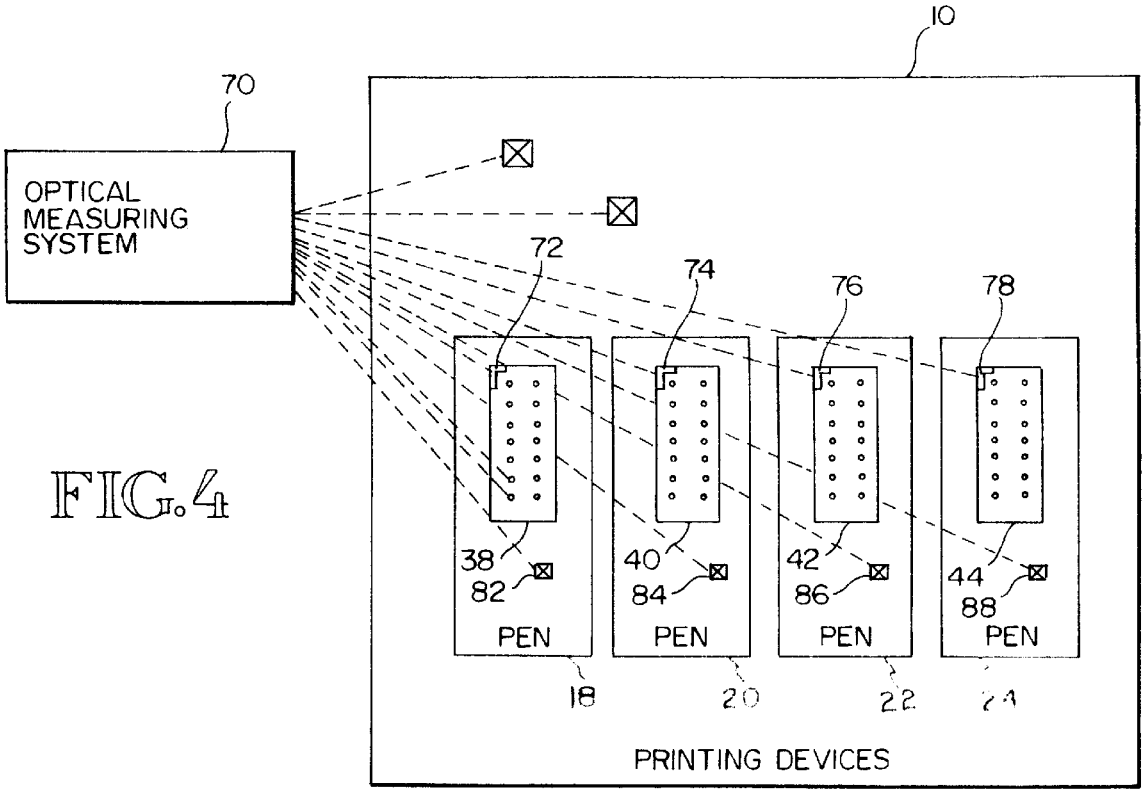
FIG. 4 is a block diagram of an inkjet printing device and optical measuring system for performing optical measuring steps according to method embodiments of this invention.

According to various alternative methods of this invention, misalignment of the printhead and nozzles is measured optically. FIG. 4 shows a block diagram of the inkjet printing device 10 and an optical measuring system 70. According to varying embodiments the optical measuring system 70 is a stand-alone system or an integral part of the printing device 10. The optical measuring system includes one or more light-emitting or infrared emitting devices and one or more light detection or infrared detection devices. In addition, the system 70 includes structures for directing and/or scanning the emitting and detecting devices to desired locations, along with logic or processing devices for determining-absolute or relative position measurements. For example, in one embodiment the system 70 is locked on a first target, then a second target thereafter, the distance between the two targets is calculated.

According to one measuring method of this invention, the distance from each nozzle 56 of a given printhead 38 to a reference point 72 on such printhead 38 is measured by the system 70. The position of each nozzle 56 on such printhead 38 also is measured with respect to reference points 74, 76, 78 on each of the other printheads (e.g., 40, 42, 44). The process then is repeated for each nozzle on each printhead 40–44. The reference points 72–78 are datums manufactured into each printhead as an elevated structure of known size and shape. According to an alternative method step, the position of each nozzle is optically measured with respect only to the reference point on the same printhead as the nozzle being measured. In such embodiment the optical measuring system measures the distance between each reference point 72–78 of each printhead 38–44.

According to another alternative embodiment, the position of each nozzle of each printhead is measured with respect to a reference point on the pen body upon which each given nozzle resides. Thus, the nozzles of printhead 38 are measured with respect to a reference point 82 on pen 18. The nozzles of printhead 40 are measured with respect to a reference point 84 on pen 20. The nozzles of printhead 42 are measured with respect to a reference point 86 on pen 22. Similarly, the nozzles of printhead 44 are measured with respect to a reference point 88 on pen 24. The position of each nozzle then is measured with respect to each of the other pen body reference points 82–88, or the position between each reference point 82–88 is measured. Exemplary reference points for the pen bodies are shown in FIG. 2. Various datums 94, 96, 98, 100, 102, 104 are manufactured on the pens 18–24 for use in positioning each pen in the carriage 26 or positioning the printhead on the pen.

Still another alternative is to measure the nozzles, the printhead reference points 72–78 and/or the pen body reference points 82–88 with respect to a reference point 90 on the pen carriage assembly or some other printing device reference point 92 (see FIG. 1) on the printing device housing or other component. In the various alternatives, the position of each nozzle is measured relative to one or more reference points so that the relative position of nozzles of all printheads 38–44 can be determined. Specifically, the alignment or lack of alignment of each nozzle is determined. For misalignment the characteristic misalignment or misalignment pattern is determined. For example, the x-offset, y-offset or z-offset of a nozzle is determined. Also, a pattern of misalignment, such as the x-offset, y-offset, z-offset or rotational offset of a row is determined. As the nozzles of a given printhead typically are precisely aligned relative to such printhead, it is the variations from printhead to printhead caused by printhead misalignment that is of most concern. Thus, patterns of misalignment are expected.

For nozzles manufactured to precise alignment with respect to its printhead, the measurement process can be simplified by simply measuring a printhead reference point relative to other reference points (e.g., on same pen, plus reference points on other pens/printheads). Specifically, the position of each nozzle need not be measured since it is known with respect t o other nozzles on the same printhead. Typical alignment precision desired for 600 dots per inch printing is 1/600 inch (i.e., 0.0012 inch m/l) dot-to dot position placement on the media sheet.

Measurement Storage

Once the measurements are made, the measurements values a coded representation thereof, or some other data indicative of absolute or relative position or alignment is stored. For example, in one embodiment a value is stored for each nozzle. Such value represents a distance in known units of offset in x, y and/or z dimensions for the given nozzle relative to an aligned position of such nozzle. Alternatively, the value is relative to a known reference point or to a known relative coordinate system.

In one embodiment the values for a given printhead 38 are stored electronically in circuitry on the flex circuit 52 or elsewhere on the pen 18 of such printhead 38. In another embodiment the values are stored as a bar code on a bar code label 110 (see FIG. 2), which can be read by an optical scanning device.

Figure 5:
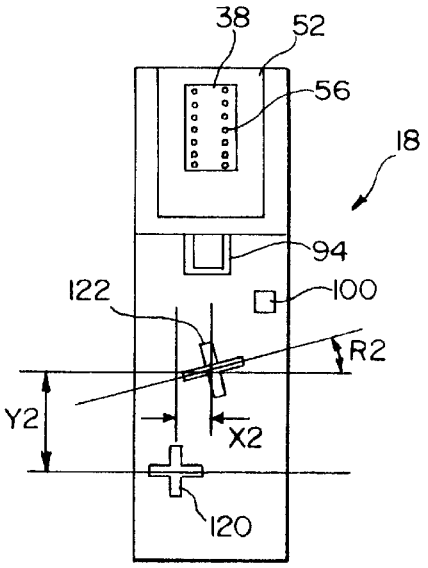
FIG. 5 is a planar view of a inkjet pen according to one embodiment of this invention.

In another embodiment, useful for misalignment patterns, markings are applied to the pen which exaggerate the misalignment. FIG. 5 shows a pen embodying such markings. A first marking 120 serves as a reference marking a second marking 122 is set-off from the first marking in the x, and/or y and/or z direction. The second marking 122 also is rotated with respect to the first marking. The set-off distances and angle of rotation between the first and second markings are multiples of the actual set-off pattern ocurring among nozzles on the printhead. Consider the example in which the second marking is set-off by X2 (e.g., 0.02 inches) in an x direction, Y2 (e.g., 0.04 inches) in the y direction and 0.0 in the z direction. For a multiple of 100, a second nozzle in a row is offset by 0.02/100=0.0002 inches in the x direction and 0.04/100=0.0004 inches in the y direction from where it should be positioned with regard to a first nozzle in the row if properly aligned. Each subsequent nozzle is further displaced by another 0.0002 inches in the x direction and 0.0004 inches in the direction causing an accumulated offset from its aligned position. Consider also that the first marking 120 and the second marking 122 are crosses and that the second marking 122 cross orientation is rotated in comparison to the first marking cross orientation by R2 (e.g., 10 degrees). For a multiple of 100, each nozzle row of the printhead is skewed at an angle of 10/100=0.1 degrees out of alignment. Note that the multiples for the offsets and rotation may be the same or vary, but are known so the relation to the actual misalignment can be determined. In one embodiment, the first marking 120 is fixed at a given location on the pen, while the second marking 122 is adjustable to define x-offset, y-offset, z-offset and/or rotational skew. For such embodiment, the second marking 122 is adjusted after optical measurement to define (and thus store) the misalignment information.

Although particularly suited for pens having printheads permanently positioned relative to a carriage 26, the inventive methods also are applicable to replaceable pens with attached printheads. When a new pen replaces an existing pen in the carriage 26, the nozzle location information is introduced to the printer in a manner that permits recomputation of nozzle timing signals. For example, nozzle measurements relative to a reference point on the point are stored by one of the methods described above (e.g., electronic storage, bar code label, markings). By accurately placing the reference point of a pen at the same location on all pens and by accurately positioning the pen in the carriage, the embedded data is representative of printhead misalignment relative to the pen. Thus, the embedded data is used in place of similar data for the prior pen.

Measurement Retrieval and Timing Compensation

Typically the misalignment information is stored or embedded in the pens 18–24 at the factory once the pens 18–24 are assembled and installed in the print carriage 26. Thereafter the measurement information is accessed. For data stored electronically, the electronic storage medium is accessed. For example a printer processor or printhead controller accesses the information to adjust the nozzle timing signals so as to compensate for misalignment. For bar code data, an optical sensor device within the printer reads the bar code. The encoded information of the bar code then is accessed by the print processor or printhead controller to adjust the nozzle timing signals to compensate for misalignment. Alternatively an external device scans the bar code. The encoded data then is input to the printer or to a host computer. The host computer then downloads the information to the printer. The print processor or printhead controller then adjusts the nozzle timing signal to compensate for misalignment. Alternatively, the host computer processes the encoded data then downloads signals for prompting the print processor or printhead controller to adjust the nozzle timing signals.

For the physical marking manner of storing measurement data as described above with regard to FIG. 5, a user or an optical sensing device measures the offsets between the two markings 120, 122, then feeds the data into a host computer. The host processes the data then downloads processed data to the printer, or otherwise directly downloads the measurement data to the printer.

Meritorious and Advantageous Effects

One advantage of the invention is the manufacturing tolerances for printer carriage and pen components can be slightly relaxed where burdensome. Such relaxed tolerances are accounted for by the optical measurement and storage of alignment data. Thus, one or more printheads are able to print to desired accuracies. Although a preferred embodiment of the invention has been illustrated and described, various alternatives, modifications and equivalents may be used. For example, additional storage methods for embedding the measurement data at the pen includes magnetic striping and other known methods. Also, although described for multiple scanning pens, the methods also are applicable for one or more page-wide array permanent or replaceable printheads. Therefore, the foregoing description should not be taken as limiting the scope of the inventions which are defined by the appended claims.

What is claimed is:

1. An inkjet pen for use with an inkjet printing device, comprising:

a printhead comprising a plurality of nozzles, each one of said plurality of nozzles defining a nozzle chamber for receiving ink;

a pen body to which the printhead is attached, the pen comprising a reservoir for holding ink, the reservoir coupled to the nozzle chambers;

a reference point against which locations of the printhead nozzles are measured, wherein the reference point is at a fixed location on the pen;

means for storing a misalignment indicator corresponding to a misalignment of the printhead, the misalignment indicator derived from printhead nozzle locations.

2. The pen apparatus of claim 1, in which the printhead further comprises electronic memory which serves as the storing means.

3. An inkjet pen apparatus for use with an inkjet printing device, comprising:

a printhead comprising a plurality of nozzles, each one of said plurality of nozzles defining a nozzle chamber for receiving ink;

a pen body to which the printhead is attached, the pen comprising a reservoir for holding ink, the reservoir coupled to the nozzle chambers;

a reference point against which locations of the printhead nozzles are measured; and means for storing a misalignment indicator corresponding to a misalignment of the printhead, the misalignment indicator derived from printhead nozzle locations, in which the storing means comprises an optically detectable bar code.

4. An inkjet pen apparatus for use with an inkjet printing device, comprising:

a printhead comprising a plurality of nozzles, each one of said plurality of nozzles defining a nozzle chamber for receiving ink;

a pen body to which the printhead is attached, the pen comprising a reservoir for holding ink, the reservoir coupled to the nozzle chambers;

a reference point against which locations of the printhead nozzles are measured; and means for storing a misalignment indicator corresponding to a misalignment of the printhead, the misalignment indicator derived from printhead nozzle locations, in which the storing means comprises a first marking on the pen body and a second marking on the pen body, and wherein the relative offset of the second marking to the first marking is indicative of printhead misalignment.

5. The pen apparatus of claim 4, in which the second marking is adjustable to define a rotational offset relative to the first marking which is indicative of rotational skew of a nozzle row on the printhead.

6. The pen apparatus of claim 4, in which the second marking is adjustable relative to the first marking to define orthogonal offsets of a nozzle row within a plane of the printhead.

7. An inkjet pen apparatus for use with an inkjet printing device, comprising:

a printhead comprising a plurality of nozzles, each one of said plurality of nozzles defining a nozzle chamber for receiving ink;

a pen body to which the printhead is attached, the pen comprising a reservoir for holding ink, the reservoir coupled to the nozzle chambers;

a reference point against which locations of the printhead nozzles are measured; and means for storing a misalignment indicator corresponding to a misalignment of the printhead, the misalignment indicator derived from printhead nozzle locations, in which the reference point is integral to the printhead.

8. An inkjet pen apparatus for use with an inkjet printing device, comprising:

a printhead comprising a plurality of nozzles, each one of said plurality of nozzles defining a nozzle chamber for receiving ink;

a pen body to which the printhead is attached, the pen comprising a reservoir for holding ink, the reservoir coupled to the nozzle chambers;

a reference point against which locations of the printhead nozzles are measured; and means for storing a misalignment indicator corresponding to a misalignment of the printhead, the misalignment indicator derived from printhead nozzle locations, in which the reference point is integral to the pen body.

9. A method for adjusting the timing of printhead nozzles to compensate for printhead misalignment in an inkjet printing apparatus comprising a plurality of inkjet pens, each one of the plurality of inkjet pens comprising a printhead, a pen body to which the printhead is attached, and a fixed reference point, each printhead having a plurality of nozzles through which ink is ejected for printing to a media sheet, the method comprising the steps of:

for each printhead optically measuring printhead alignment relative to the reference point of the pen comprising such printhead; and embedding printhead misalignment data into each pen, said data corresponding to the printhead of the pen at which the data is embedded.

10. The method of claim 9 in which each pen further comprises electronic memory, and in which the step of embedding comprising storing the printhead alignment data in the electronic memory of the pen to which the data pertains.

11. The method of claim 9 further comprising the steps of: retrieving the printhead misalignment data and adjusting nozzle timing to compensate for printhead misalignment.

12. The method of claim 9 in which each pen further comprises a first marking and a second marking, and in which the step of embedding comprises adjusting position of the second marking relative to Position of the first marking, and in which the relative position of the first marking and second marking embodies the printhead misalignment data.

13. The method of claim 12 in which the relative position indicates any one or more of a first planar offset, a second planar offset and a rotational offset, each one of the first planar offset, second planar offset and rotational offset occurring in a plane of the printhead, and in which the first planar offset is for a direction orthogonal for a direction of the second planar offset.

14. A method for adjusting the timing of printhead nozzles to compensate for printhead misalignment in an inkjet printing apparatus comprising a plurality of inkjet pens, each one of the plurality of inkjet pens comprising a printhead, a pen body to which the printhead is attached, and a reference point, each printhead having a plurality of nozzles through which ink is ejected for printing to a media sheet, the method comprising the steps of:

for each printhead optically measuring printhead alignment relative to the reference point of the pen comprising such printhead, in which the reference point of a given pen is integral to the pen body of the given pen; and embedding printhead misalignment data into each pen, said data corresponding to the printhead of the pen at which the data is embedded.

15. A method for adjusting the timing of printhead nozzles to compensate for printhead misalignment in an inkjet printing apparatus comprising a plurality of inkjet pens, each one of the plurality of inkjet pens comprising a printhead, a pen body to which the printhead is attached, and a reference point, each printhead having a plurality of nozzles through which ink is ejected for printing to a media sheet, the method comprising the steps of:

for each printhead optically measuring printhead alignment relative to the reference point of the pen comprising such printhead, in which the reference point of a given pen is integral to the printhead of the given pen; and embedding printhead misalignment data into each pen, said data corresponding to the printhead of the pen at which the data is embedded.

16. A method for adjusting the timing of printhead nozzles to compensate for printhead misalignment in an inkjet printing apparatus comprising a plurality of inkjet pens, each one of the plurality of inkjet pens comprising a printhead, a pen body to which the printhead is attached, and a reference point, each printhead having a plurality of nozzles through which ink is elected for printing to a media sheet, the method comprising the steps of:

for each printhead optically measuring printhead, alignment relative to the reference point of the pen comprising such printhead; and embedding printhead misalignment data into each pen, said data corresponding to the printhead of the pen at which the data is embedded, in which the step of embedding comprises applying an optically-detectable bar code of the printhead alignment data.

17. An inkjet printing apparatus, comprising:

an inkjet pen, a carriage assembly for scanning the inkjet pen, a reference point having a fixed location relative to the carriage assembly, the inkjet pen comprising:

(i) a printhead comprising a plurality of nozzles, each one of said plurality of nozzles defining a nozzle chamber for receiving ink, wherein locations of the printhead nozzles are measured relative to the fixed reference point at the carriage assembly;

(ii) a pen body to which the printhead is attached, the pen comprising a reservoir for holding ink, the reservoir coupled to the nozzle chambers; and (iii) means for storing a misalignment indicator corresponding to a misalignment of the printhead, the misalignment indicator derived from printhead nozzle locations.

18. The printing apparatus of claim 17, in which the reference point is fixed at the carriage assembly.

19. The printing apparatus of claim 17, in which the reference point to fixed to a stationary component of the printing apparatus.

20. A method for adjusting the timing of printhead nozzles to compensate for printhead misalignment in an inkjet printing apparatus comprising a carriage assembly, a plurality of inkjet pens, and a fixed reference point, each one of the plurality of inkjet pens comprising a printhead and a pen body to which the printhead is attached, each printhead having a plurality of nozzles through which ink is ejected for printing to a media sheet, the method comprising the steps of:

for each printhead optically measuring printhead alignment relative to the reference point; and embedding printhead misalignment data into each pen, said data corresponding to the printhead of the pen at which the data is embedded.

21. The method of claim 20, in which the step of measuring comprises, measuring printhead alignment relative to the reference point, wherein the reference point is fixed at the carriage assembly.

22. The method of claim 20, in which the step of measuring comprises, measuring printhead alignment relative to the reference point, wherein the reference point is fixed at a stationary component of the inkjet printing apparatus.

23. A method for adjusting the timing of printhead nozzles to compensate for printhead misalignment in an inkjet printing apparatus comprising a plurality of inkjet pens, each one of the plurality of inkjet pens comprising a printhead, a pen body to which the printhead is attached, and a reference point, each printhead having a plurality of nozzles through which ink is elected for printing to a media sheet, the method comprising the steps of:

for each printhead optically measuring printhead alignment relative to the reference point of the pen comprising such printhead; and embedding printhead misalignment data into each pen, said data corresponding to the printhead of the pen at which the data is embedded;

in which the step of measuring for each given printhead comprises measuring the location of each nozzle of the given printhead relative to the reference point of the pen comprising the given printhead.

24. The method of claim 23, further comprising the step of measuring for each given printhead the location of each nozzle of the given printhead relative to the reference point of each of the other pens, and in which the printhead alignment data is derived from measured nozzle locations relative to the reference points of a plurality of the pens.

* * * * *

UNITED STATES PATENT AND TRADEMARK OFFICE

CERTIFICATE OF CORRECTION

PATENT NO. : 5,847,722
DATED : December 8, 1998
INVENTOR(S) : Hackleman

It is certified that error appears in the above-identified patent and that said Letters Patent is hereby corrected as shown below:

Column 4,
Line 49, delete “determining-absolute” and insert therefor -- determining absolute --.

Column 9,
Line 7, delete “Position” and insert therefor -- position --.
Line 54, delete “elected” and insert therefor -- ejected --.
Line 56, after the second “printhead”, delete “,”.

Column 10,
Line 17, delete the first “to” and insert therefor -- is --.
Line 47, delete “elected” and insert therefor -- ejected --.

Signed and Sealed this

Twenty-first Day of October, 2003

JAMES E. ROGAN
*Director of the United States Patent and Trademark Office*